US007500832B2

(12) United States Patent
Zagar et al.

(10) Patent No.: US 7,500,832 B2
(45) Date of Patent: Mar. 10, 2009

(54) TURBINE BLADE SELF LOCKING SEAL PLATE SYSTEM

(75) Inventors: Thomas W. Zagar, Winter Springs, FL (US); Rafael A. De Cardenas, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 295 days.

(21) Appl. No.: 11/481,722

(22) Filed: Jul. 6, 2006

(65) Prior Publication Data

US 2008/0008593 A1 Jan. 10, 2008

(51) Int. Cl.
*F01D 5/32* (2006.01)

(52) U.S. Cl. ..... 416/221; 416/96 R; 416/220 R

(58) Field of Classification Search ..... 416/95, 416/96 R, 97 R, 215–218, 220 R, 221, 248
See application file for complete search history.

(56) References Cited

U.S. PATENT DOCUMENTS 3,045,329 A * 7/1962 Carli et al. ..... 416/221
3,096,074 A * 7/1963 Pratt et al. ..... 416/215
3,501,249 A * 3/1970 Scalzo et al. ..... 416/95
3,572,966 A 3/1971 Borden
3,644,058 A 2/1972 Barnabei et al.
3,728,042 A 4/1973 Hugoson et al.
3,748,060 A 7/1973 Hugoson et al.
3,853,425 A 12/1974 Scalzo et al.
4,108,571 A * 8/1978 Mawson ..... 416/221
4,523,890 A 6/1985 Thompson
4,669,959 A 6/1987 Kalogeros
6,273,683 B1 8/2001 Zagar et al.
6,416,282 B1 7/2002 Beeck et al.
6,454,526 B1 9/2002 Cunha et al.
6,561,764 B1 5/2003 Tiemann
7,371,050 B2 * 5/2008 Pasquiet ..... 416/221

* cited by examiner

*Primary Examiner*—Christopher Verdier

(57) ABSTRACT

A seal plate system (24) for a rotor in a turbine engine. The rotor includes a rotor disc (10) for supporting a plurality of blades (16), and an annular groove (32) provided in the disc (10) adjacent at least one end (30) of the disc (10). A plurality of plate structures (60) are provided supported between the annular groove (32) of the disc (10) and a groove (56) formed in a platform (26) of the blade (16) adjacent an end (30) of the disc (10). The plate structure (60) includes a plate (64) and an elongated resilient locking pointer (66) extending from the plate (64) for engaging in a lock notch (98) formed in an outer wall (38) of the annular groove (32). The locking pointer (66) forms a self-locking feature that is biased into the lock notch (98) as the plate structure (60) is moved into position on the disc (10).

20 Claims, 6 Drawing Sheets

TURBINE BLADE SELF LOCKING SEAL PLATE SYSTEM

FIELD OF THE INVENTION

The present invention relates generally to turbine blades and, more particularly, to a structure for locking turbine rotor blades in the periphery of a blade supporting disc and for providing cooling passages for cooling the root portions of the blades in a turbine.

BACKGROUND OF THE INVENTION

Generally, combustion turbines have three main assemblies, including a compressor assembly, a combustor assembly, and a turbine assembly. In operation, the compressor assembly compresses ambient air. The compressed air is channeled into the combustor assembly where it is mixed with a fuel. The fuel and compressed air mixture is ignited creating a heated working gas. The heated working gas is typically at a temperature of between 2500 to 2900° F. (1371 to 1593° C.), and is expanded through the turbine assembly. The turbine assembly generally includes a rotating assembly comprising a centrally located rotating shaft supporting rotor discs and a plurality of rows of rotating rotor blades attached thereto. A plurality of stationary vane assemblies including a plurality of stationary vanes are connected to a casing of the turbine and are located interposed between the rows of rotor blades. The expansion of the working gas through the rows of rotor blades and stationary vanes in the turbine assembly results in a transfer of energy from the working gas to the rotating assembly, causing rotation of the shaft. A known construction for a combustion turbine is described in U.S. Pat. No. 6,454,526, which patent is incorporated herein by reference.

It is known that higher inlet operating temperatures in the turbine assembly will provide higher thermal efficiency and specific power output. It is also known that the allowable stress to which the rotor blades of the turbine assembly can be subjected for a given blade life decreases with increasing temperatures of the working gas. Thus, a limiting factor in raising turbine efficiency and power output is the physical capability of the rotor blades in relation to the temperatures within the turbine.

Cooling the blades, or forming the blades from temperature resistant materials, or both, is often necessary to reach the desired inlet temperatures. Cooling the blades can be accomplished by using a cooling fluid, such as some of the air normally supplied to the turbine by the compressor in its regular mode of operation. It is known to provide radial passages for directing the cooling fluid through the blades where a portion of a blade may be abutted against a seal plate engaged in grooves in the rotor disc and in the blade. The seal plates secure the blades to the rotor disc by preventing axial movement of the blades relative to blade mounting recesses in the disc. In addition, the seal plates seal cooling fluid flow paths that extend to the upstream and/or downstream sides of the blades adjacent lower surfaces of blade platforms defining an inner flowpath for the working fluid.

U.S. Pat. No. 3,572,966 discloses a seal plate for rotor blades in which sideplates are described as fitting within grooves formed in a rotor disc and in rotor blades. The sideplates are located and retained in position by bolts and retaining pins and clips. In such an arrangement multiple parts must be manipulated during assembly, increasing the difficulty of the assembly operation, and maintenance difficulties may arise during disassembly due to breakage of the bolts.

U.S. Pat. No. 4,669,959 discloses a breach lock for retaining a rear seal plate in place. The breach lock includes a key for maintaining the circumferential position of the rear seal plate, and a sheet metal tab is located in a slot of the key and is deformed to maintain the key in position. This construction requires manipulation of multiple parts to position and lock the seal plates in place. Further, structures implementing bent or deformed parts typically require replacement of the deformed parts during the reassembly operation, thus adding to maintenance costs.

Accordingly, there continues to be a need for a seal plate system that minimizes the number of parts requiring manipulation, and that enables the seal plate to be readily installed and removed from the blade supporting disc during maintenance operations.

SUMMARY OF THE INVENTION

In accordance with one aspect of the invention, a structure is provided in a rotor for a turbine engine, where the rotor includes at least one rotor disc with blade mounting sections provided in the periphery thereof for receiving and mounting blades. The improvement comprises an annular, continuous groove provided in the disc adjacent at least one end of the blade mounting sections, blade platforms having grooves in radial alignment with the annular groove, and a plurality of plate structures adapted to be disposed and supported between the disc and the blade platforms, and located in the grooves to form an annular array of the plate structures. A plurality of lock notches are formed in an outer wall of the annular groove, and the plate structures comprise a plate and a locking pointer. The locking pointer extends axially toward the outer wall and engages within a respective lock notch to maintain a circumferential position of the plate structures relative to the disc.

In accordance with another aspect of the invention, a structure is provided in a rotor for a turbine engine, where the rotor includes at least one rotor disc with axially extending peripheral recesses provided in the periphery thereof for receiving the root portions of blades. The improvement comprises an annular, continuous groove provided in the disc adjacent at least one end of the peripheral recesses, the disc including a ledge portion extending from an inner wall of the annular groove and partially closing the annular groove to form a relatively narrow entrance portion thereto, blade platforms having grooves in radial alignment with the annular groove, and a plurality of plate structures adapted to be disposed and supported between the disc and the blade platforms, and located in the grooves to form an annular array of the plate structures. A plurality of lock notches are formed in an outer wall of the annular groove, and the plate structures comprise a plate and a locking pointer. The locking pointer extends axially and radially inwardly toward the outer wall and has an end engaged within a respective lock notch to maintain a circumferential position of the plate structures relative to the disc.

In a further aspect of the invention, a structure is provided in a turbine engine comprising a rotor including at least one rotor disc with blade mounting sections provided in the periphery thereof for receiving and mounting blades, the disc including an annular groove adjacent at least one end of the blade mounting sections, a plurality of radially extending lock notches formed in an outer wall of the annular groove, and blade platforms having grooves in radial alignment with the annular groove. The structure including a plate structure comprising a generally planar plate for extending between the disc and the blade platforms, and including inner and outer edges for engagement in the grooves. The structure additionally includes an elongated locking pointer mounted on the plate at an attachment location and including a distal end spaced from the attachment location toward the inner edge. The locking pointer extends axially and radially inwardly toward the outer wall when the plate structure is mounted to the disc for positioning the distal end within one of the lock notches to maintain a circumferential position of the plate structure relative to the disc.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
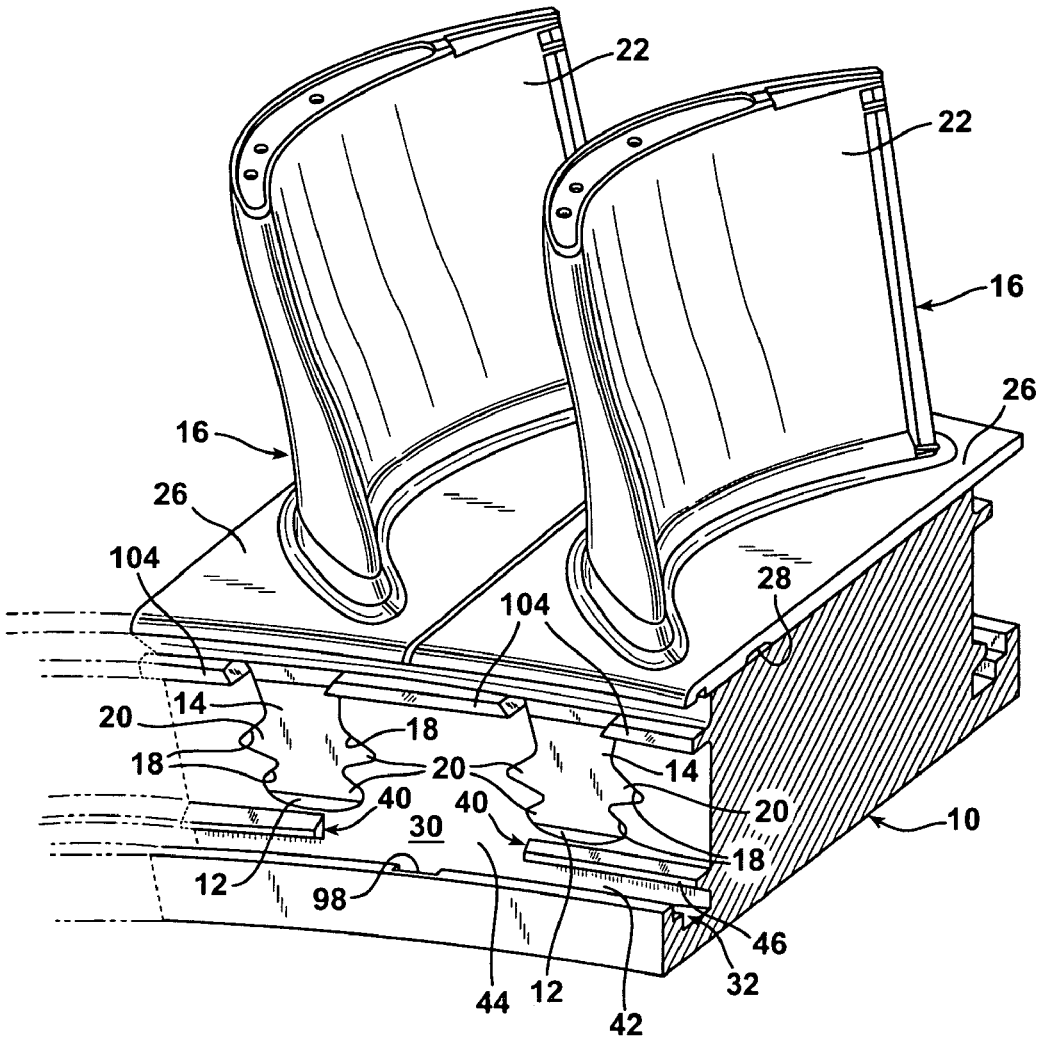
FIG. 1 is a partial front perspective view of an upstream side of a rotor disc configured for mounting seal plate structures in accordance with the present invention.

FIG. 1 illustrates a basic construction of part of a turbine rotor in a turbine assembly for a combustion turbine engine, such as a gas turbine engine, and in particular illustrates an outer peripheral portion of a disc 10 for the rotor. It should be noted that although the portion of the disc 10 illustrated in the figures appears as a disc segment, the disc 10 is preferably formed as a substantially continuous ring structure within the turbine assembly.

The disc 10 defines peripheral blade mounting sections comprising axially extending peripheral recesses 12, generally aligned along the longitudinal axis (not shown) of the rotor, for receiving the root portions 14 of rotor blades 16. The recesses 12 may be provided with undercuts 18. A rotor blade 16 is inserted with its root portion 14 passing through the recess 12 in the axial direction of the recess 12. The root portion 14 is supported with longitudinal ribs 20 on the undercuts 18 of the recess 12. In this way, during rotation of the disc 10 about the longitudinal axis of the rotor, the blade 16 is held counter to centrifugal forces occurring in the direction of a longitudinal axis of an airfoil 22 of the blade 16. The blade 16 is further secured against movement out of the recess 12 in the direction of insertion, i.e., in the longitudinal direction of the recess 12, by additional means comprising a seal plate system 24 (see FIGS. 3 and 6), as will be described further below. It should be noted that although the following description is particularly directed to a portion of the seal plate system 24 provided to the upstream side of the disc 10, the present invention additionally may be applied to the downstream side of the disc 10, where the structure of the portion of the seal plate system 24 for the downstream side is substantially similar to the portion of the structure described for the upstream side of the seal plate system 24.

Above the root portion 14, the blade 16 includes a widened region comprising a blade platform 26. The airfoil 22 of the blade 16 is located on an outer side of the blade platform 26, where the outer side is located opposite a disc-side base 28 of the blade platform 26. The hot working gas required for operating the turbine engine flows past the airfoils 22 of the blades 16 to generate a torque on the disc 10 and rotate a drive shaft (not shown) of the turbine engine. In order to enable the blades 16 to operate at high operating temperatures of the turbine assembly, a cooling fluid such as a cooling air flow, is typically provided to an internal cooling system (not shown) passing through the airfoil 22 and adjacent to the blade root portions 14. The disc 10 may include radial passages (not shown) for directing a cooling air flow from a passageway, providing air from the compressor for the engine, radially outwardly through the disc 10 to the recess 12 receiving the root portion 14. The cooling air may flow axially along the recess 12 to the ends 30 of the disc 10 and blade root portions 14.

The seal plate system 24 facilitates sealing the disc-side base 28 of the blades 16 and the blade root portions 14 from the hot working fluid, as well as directing cooling fluid though continuous circumferential passages or chambers 62 adjacent longitudinal ends 30 of the disc 10 and blade root portions 14.

Figure 2:
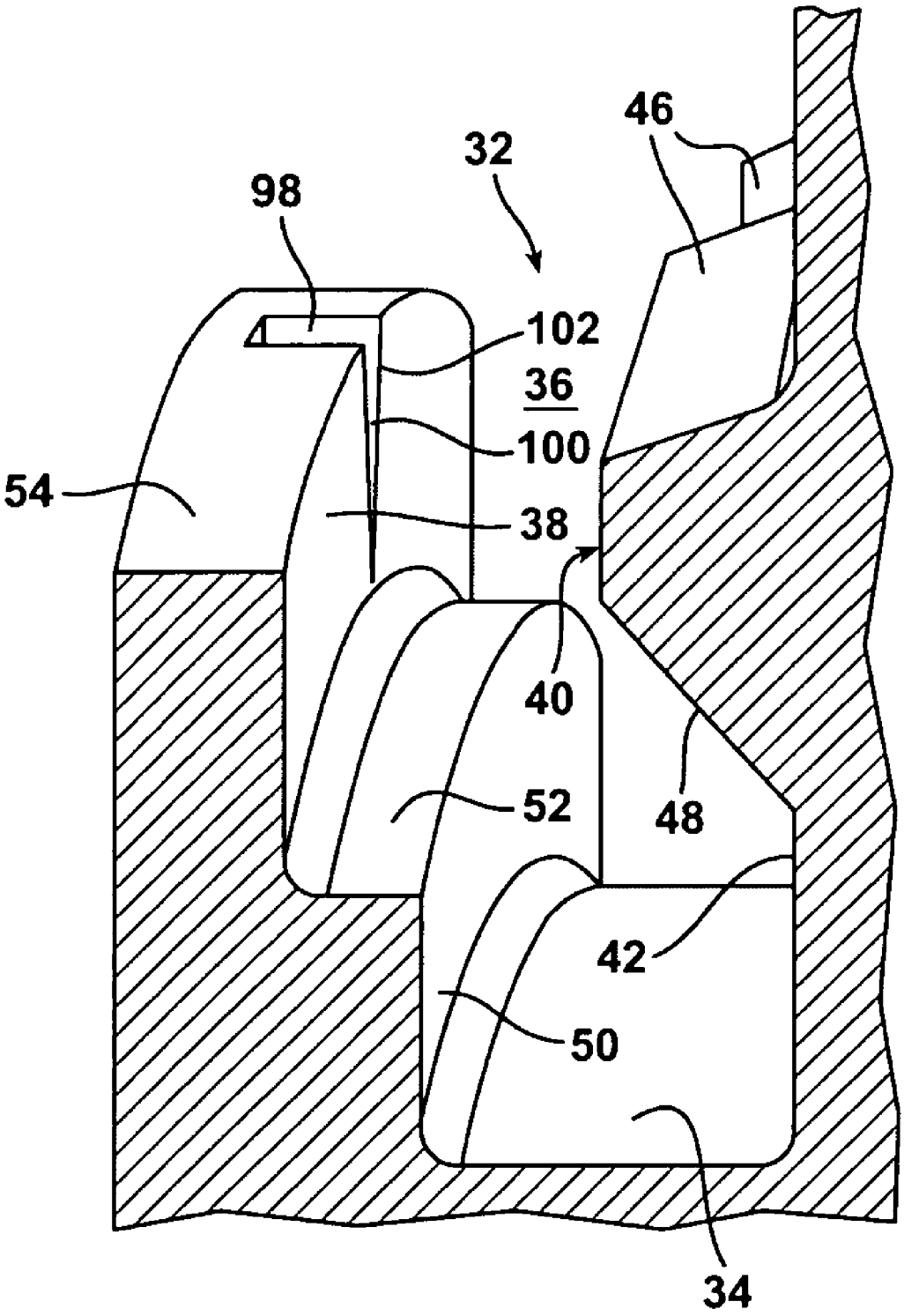
FIG. 2 is an enlarged perspective view of an annular groove of the disc shown in FIG. 1.

Referring to FIGS. 1 and 2, the disc 10 is shown as including an annular, continuous groove 32 or channel including a bottom wall 34 facing in a radially outward direction. The annular groove 32 is located adjacent a radial inner portion of the recesses 12 and is in fluid communication with cooling air supplied to the recesses 12.

The annular groove 32 is provided with a somewhat narrow entrance portion 36 defined between an outer wall 38 of the disc 10 and an axially extending circumferential ledge portion 40 of the disc 10, extending from an inner wall 42 of the disc 10. The ledge portion 40 is provided with circumferentially spaced slots 44 (only one shown), such that the ledge portion 40 comprises a plurality of lugs 46 separated by the slots 44 and located circumferentially around the inner wall 42 of the disc 10. The ledge portion 40 also includes an inclined surface 48 that is inclined radially outwardly in a direction extending away from the inner wall 42. In addition, an intermediate wall 50 extends radially outwardly from the bottom wall 34, and a shelf portion 52 extends axially between the outer wall 38 and the intermediate wall 50, spaced axially inwardly from a radially outer edge 54 of the outer wall 38.

Figure 3:
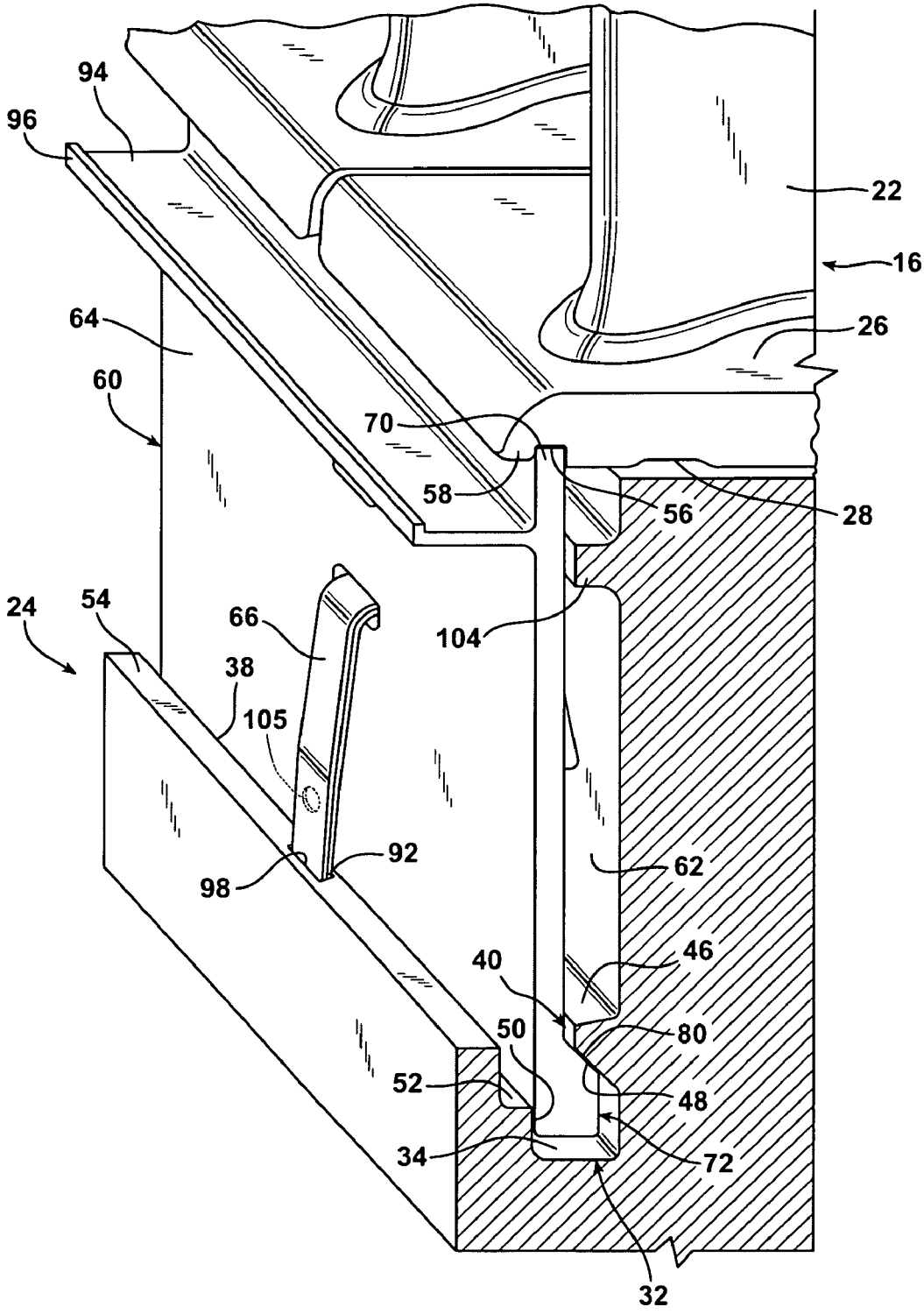
FIG. 3 is an enlarged side perspective view of a seal plate structure mounted to the disc.
Figure 6:
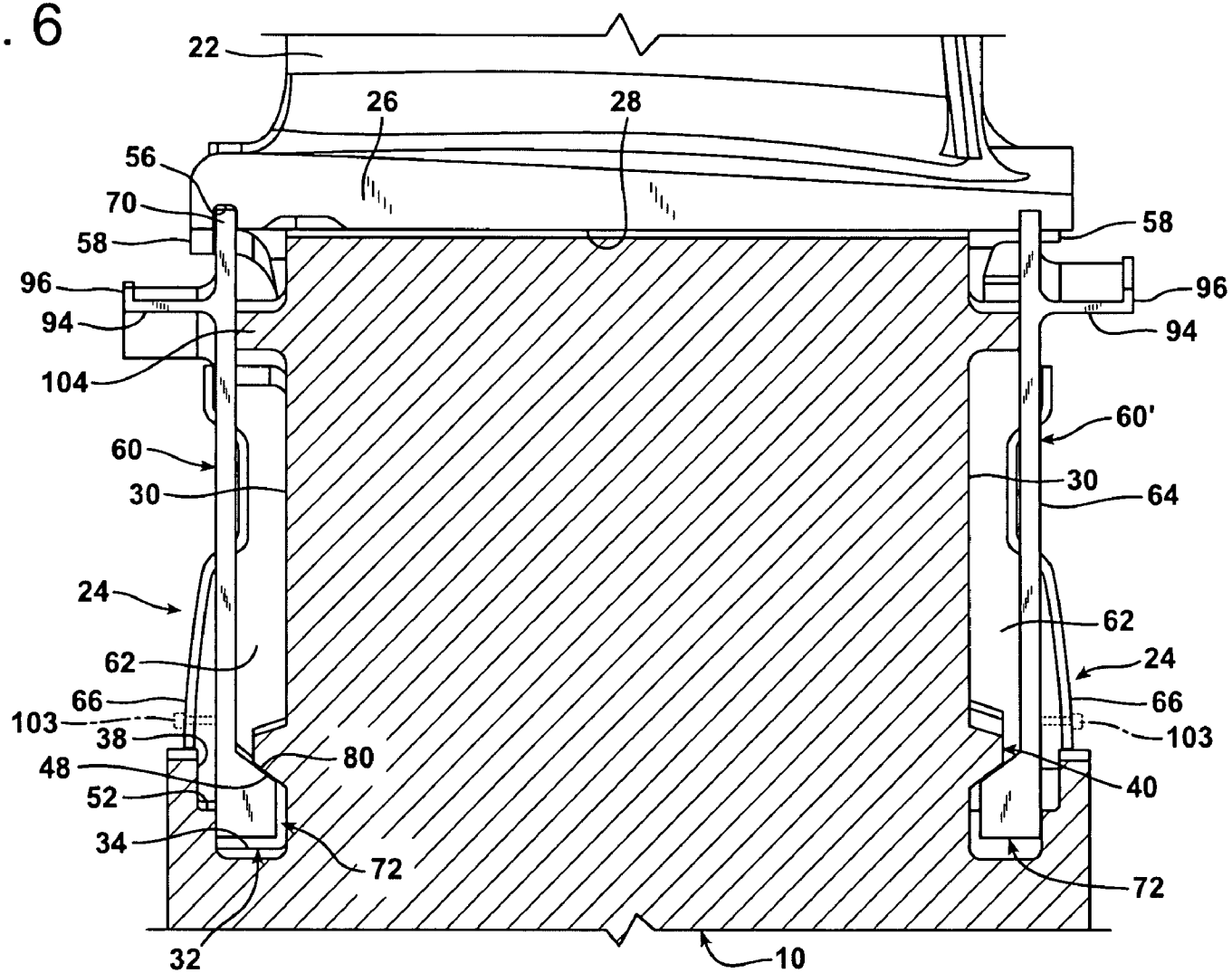
FIG. 6 is a cross-sectional view through a portion of the disc, illustrating front and rear seal plate structures mounted to the disc.

Referring to FIGS. 3 and 6, the disc-side base 28 of the blade platform 26 is further provided with a radially inwardly facing groove 56, shown here as being formed by an inwardly directed lip 58. The groove 56 in the platform 26 is in substantial radial alignment with the annular groove 32 in the disc 10. The grooves 32 and 56 are dimensioned to accommodate an annular array of seal plate structures 60 which, when installed on the disc 10 and secured in the grooves 32 and 56, form the continuous circumferential coolant chamber 62 with the adjacent ends of the blade root portions 14 and inner wall 42 of the disc 10, only one such seal plate structure 60 being shown herein.

Figure 4:
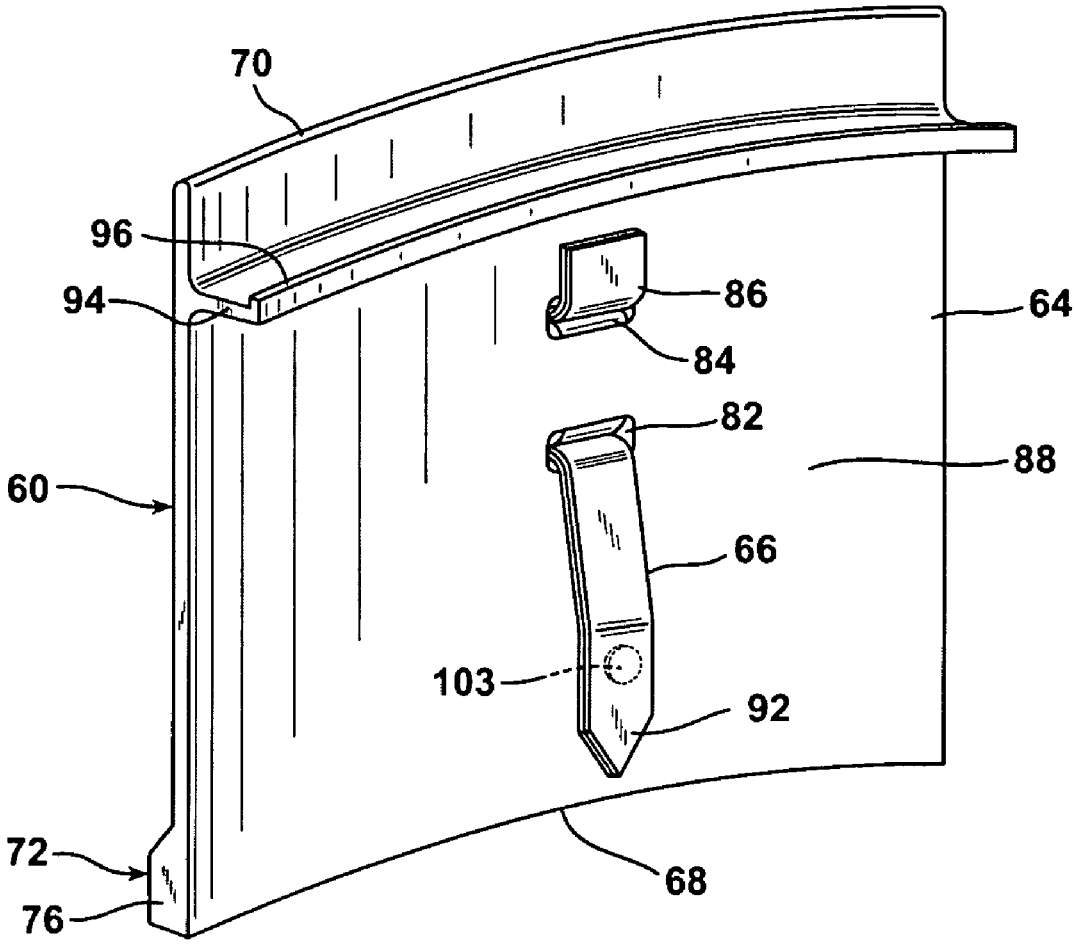
FIG. 4 is a front perspective view of a seal plate structure in accordance with the present invention.
Figure 5:
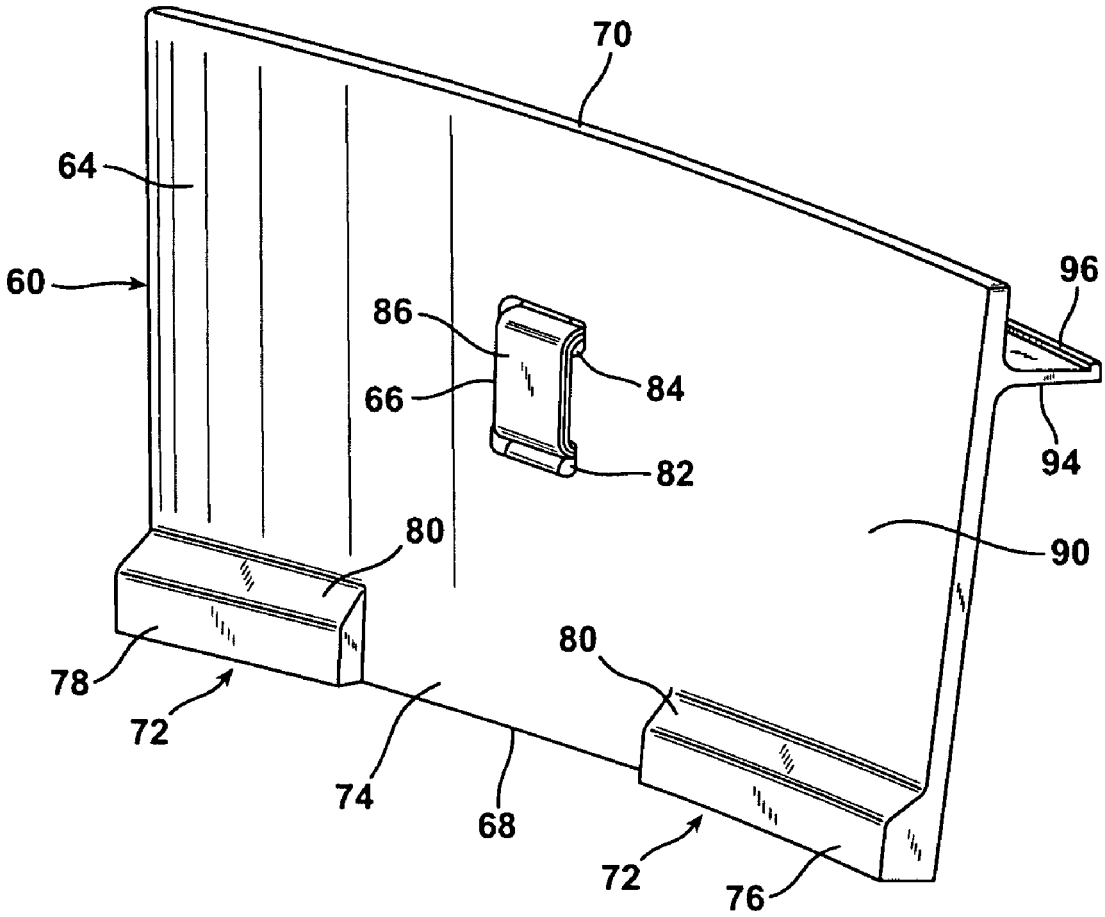
FIG. 5 is a rear perspective view of the seal plate structure shown in FIG. 4.

Referring to FIGS. 4 and 5, each seal plate structure 60 comprises a generally planar plate 64 and an elongated locking pointer 66. The plate 64 comprises inner and outer edges 68, 70 for engaging within the annular groove 32 and the grooves 56 in the platforms 26, respectively. A foot portion 72 extends from the inner edge 68 of the plate 64 and is dimensioned to seat in the annular groove 32 in the space between the inner wall 42 and the intermediate wall 50. The foot portion 72 is provided with a slot 74, to thereby define a pair of lugs 76, 78, the slot 74 being dimensioned to accommodate the ledge portion 40, i.e., the lug 46, defined on the disc 10. The foot portion 72 also comprises an inclined surface 80 defined on the lugs 76, 78, inclined radially inwardly in a direction extending away from the plate 64, when positioned on the disc 10, for cooperating engagement with the inclined surface 48 of the ledge portion 40.

The locking pointer 66 comprises an elongated resilient member, and may be formed of an elastically resilient material, such as Nimonic® 75. In the illustrated construction, the plate 64 comprises a pair of spaced slots 82, 84 defining an attachment location for receiving an outer end 86 of the locking pointer 66. The outer end 86 of the locking pointer 66 extends through the slot 82 from a first side 88 to a second side 90 of the plate 64, and extends through the slot 84 from the second side 90 to the first side 88 to define a threaded portion of the locking pointer 66 mounted to the plate 64 at the attachment location. It should be noted that other attachment mechanisms may be implemented for fastening the locking pointer 66 to the plate 64 including, without limitation, welding, rivets or other techniques for forming a connection between the locking pointer 66 and plate 64.

In addition, the locking pointer 66 comprises a tapered distal end 92 extending toward the inner edge 68 of the plate 64, and biased to a position in spaced relation to the first side 88 of the plate 64. The distal end 92 of the locking pointer 66 is preferably resiliently movable toward the first side 88 of the plate 64.

The seal plate structure 60 may additionally include a seal arm 94 extending from the first side 88 of the plate 64. The seal arm 94 includes an end portion 96 for cooperating with a stationary seal member (not shown) of the turbine for limiting passage of hot working gases to the disc area of the turbine.

Referring to FIGS. 1-3, a plurality of lock notches 98 (only one shown) are formed in the outer wall 38 at substantially equally spaced locations around the outer edge 54 of the outer wall 38, where each lock notch 98 is generally centrally aligned with one of the slots 44 in the ledge portion 40. The lock notches 98 each comprise a pair of tapered sides 100, 102 (FIG. 2) converging radially inwardly from the outer edge 54 of the outer wall 38, and are dimensioned to receive the tapered distal ends 92 of the locking pointers 66. The lock notches 98 open into the annular groove 32 at a location adjacent the shelf portion 52.

It should be understood that the distal end 92 of the locking pointer 66 is not necessarily limited to the tapered configuration illustrated herein. For example, the distal end 92 may comprise, without limitation, a round end or a substantially square end. Similarly, the lock notch 98 may be formed with a shape to substantially conform to the shape of the distal end 92 of the locking pointer 66.

The seal plate structures 60 are installed in the disc 10 by radially inserting each plate structure 60 with the lugs 76, 78 of the plate 64 passing through slots 44 in the ledge portion 40 to position the foot portion 72 in the annular groove 32, with the distal end 92 of the locking pointer 66 positioned against the outer wall 38 and adjacent the shelf portion 52. The plate structure 60 is moved circumferentially through the annular groove 32 until the locking pointer 66 is aligned with a lock notch 98. The circumferential movement positions the foot portions 72 beneath the lugs 46 of the ledge portion 40. The plate structure 60 is then lifted, i.e., moved radially outwardly, into position to engage the inclined surface 80 of the foot portion 72 with the inclined surface 48 of the ledge portion 40, and the locking pointer 66 moves into position within the lock notch 98. The engagement between the inclined surfaces 48, 80 during lifting movement of the plate structure 60 causes the first side 88 of the plate 64 to move toward an engagement position with the intermediate wall 50, and the locking pointer 66 maintains the plate 64 in its lifted position.

Assembly of the plate 64 to the disc 10 may be facilitated by providing a mechanism for retaining the distal end 92 of the pointer located closely adjacent the first side 88 of the plate 64. For example, the locking pointer 66 may be provided with a hole 105 (FIG. 3), located between the distal end 92 and the attachment location on the plate 64, for receiving a threaded fastener 103 (see FIGS. 4 and 6) that may be threadably engaged in the plate 64. The threaded fastener 103 may be used to retain the locking pointer 66 close to the plate 64, clear of the outer wall 38, until the plate 64 is located in the desired circumferential position on the disc 10, at which time the fastener 103 may be removed from the plate 64, such that the fastener 103 is not present during operation of the turbine engine. Such additional structure would be advantageous in the event that the locking pointer 66 has a high degree of stiffness, resisting movement of the locking pointer 66 toward the plate 64, that may interfere with manipulation of the plate 64 to locate it in its final mounted position on the disc 10.

The height of the plate 64 is such that the outer edge 70 of the plate 64 may be displaced below, i.e., radially inwardly from, the inside surface of the groove 56 in the blade platform 26 prior to movement of the plate 64 up into its final locked position on the disc 10. Engagement of the outer edge 70 of the plate 64 against the lip 58 of the blade platform 26 limits axial movement of the blade 16 relative to the disc 10. The disc 10 is provided with axial protrusions 104 extending from the inner wall 42 for engaging the second side 90 of the plate 64 to maintain the plate 64 generally parallel to the inner wall 42 with the outer edge 70 of the plate 64 radially aligned with the grooves 32 and 56. Movement of the blade 16 is restrained in the axial direction by the lip 58 pulling the plate 64 against one or more of the protrusions 104 on the disc 10.

The seal plate structure 60 is preferably designed to span two to five, or more, of the blades 16 on the disc 10 in order to reduce costs and to reduce assembly time, as well as improve the seal of the structure 60. However, it is also possible to provide shorter spans for the seal plate structure 60, such as a seal plate structure 60 that spans a single blade 16.

It should be understood that although the seal plate structure 60 is described above with reference to an upstream seal plate structure 60 on the disc 10, a downstream seal plate structure may also be provided having the same basic structural elements as those described for the upstream seal plate structure 60, as seen in FIG. 6 in which a downstream seal plate structure 60' is shown and in which similar elements are designated with the same reference numerals as described for the upstream seal plate structure 60. It may be noted that the upstream and downstream seal plate structures 60, 60' operate together to properly retain the blade in the axial direction. In particular, the seal plate structure 60 operates to limit movement of the blade 16 in the downstream direction, and the seal plate structure 60' operates to limit movement of the blade 16 in the upstream direction. Further, the present construction providing engagement of the outer edges 70 of the plates 64 within the grooves 56 in the blade platforms 26 to locate the blades 16 is advantageous in that thermal expansion of the blade platforms 26 will not induce stress at the connection between the outer edges 70 and the grooves 56.

During operation of the rotor, the locking pointers 66 hold the seal plate structures 60 from moving circumferentially during initial engine acceleration. Subsequently, centrifugal force on the plate 64 causes the lugs 76, 78 of the plate 64 to load against the lugs 46 of the ledge portion 40. The engagement of the inclined surface 80 against the inclined surface 48, and the corresponding engagement of the first side 88 of the plate 64, adjacent the inner edge 68, against the intermediate wall 50 operate to wedge and fix the location of the plate 64 radially and axially on the disc 10 during rotation of the rotor. The centrifugal force on the plate 64 causes the plate 64 to load in tension as it is held at the foot portion 72, and advantageously substantially eliminates concerns of buckling in compression. In addition, the locking pointer 66 is unloaded as centrifugal force loads the plate 64 against the ledge portion 40, and the centrifugal force further operates to bias the locking pointer 66 outwardly from the plate 64 toward the engagement position with the lock notch 98.

The wedging of the foot portion 72 of the plate 64 against the ledge portion 40 operates to close and substantially seal the opening of the annular groove 32 during the rotation of the rotor. When all of the seal plate structures 60 are assembled between the disc 10 and the blade platforms 26, the seal plate structures 60 form a continuous circular wall and define the plenum chamber 62 between the seal plate structures 60 and the inner wall 42. Cooling air supplied through passages to cool the blade root portions 14 may be circulated through the plenum chambers 62 to provide cooling to the ends 30 of the disc 10.

The seal plate structure 60 described herein provides a self locking plate structure 60 that facilitates assembly, in that the locking pointer 66 comprises a locking structure attached to the plate 64 and biased to engage with the disc 10 to lock the plate 64 in a predetermined position without requiring manipulation by tools or assembly of locking or latching components. Accordingly, the self locking nature of the locking pointer 66 eliminates the need for additional, separate elements such as separate screws and clips, and further reduces the number of components associated with mounting and retaining the plate 64 in position.

The described seal plate structure 60 is easily mounted within the engine without special tools and with a minimum of physical manipulation. Since the locking pointer 66 is not plastically deformed to retain the plate 64 in place, the locking pointer 66 may also be easily manipulated, by pressing inwardly toward the plate 64, to release the locking pointer 66 from the lock notch 98, to permit circumferential movement of the seal plate structure 60 during removal from the disc 10. The described construction permits the seal plate structure 60 to be re-used without requiring replacement of either the plate 64.or the locking pointer 66.

In addition to reducing costs associated with additional attachment elements, the described structure eliminates free floating elements, such as screws and clips, that could become dislodged and damage the engine.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. In a rotor for a turbine engine, said rotor including at least one rotor disc with blade mounting sections provided in the periphery of the rotor disc for receiving and mounting blades, the improvement comprising:

an annular, continuous groove provided in said disc adjacent at least one end of said blade mounting sections;

blade platforms having grooves in radial alignment with said annular groove;

a plurality of plate structures adapted to be disposed and supported between said disc and said blades, and including opposing inner and outer edges located in said grooves to form an annular array of said plate structures;

a plurality of lock notches formed in an outer wall of said annular groove; and said plate structures comprising a plate and an elongated locking pointer having an outer end supported on said plate at a location between said outer wall and said blade platform, and said locking pointer extending radically inwardly toward said outer wall, and said locking pointer extending axially away from said plate toward said outer wall and having a distal end which does not extend beyond said inner edge and which is engaged within a respective lock notch to maintain a circumferential position of said plate structures relative to said disc.

2. The structure of claim 1, wherein said locking pointer comprises an elongated resilient member, said locking pointer being resiliently biased toward said outer wall to engage within said lock notch.

3. The structure of claim 2, wherein said elongated resilient member extends through said plate for supporting said locking pointer on said plate.

4. The structure of claim 2, wherein said lock notches extend radically into said outer wall.

5. The structure of claim 1 wherein said disc includes a ledge portion extending from an inner wall of said annular groove opposite from said outer wall, and said plates of said plate structures include a foot portion for engaging said ledge portion.

6. The structure of claim 5, wherein said ledge portion comprises an inclined surface, inclined radically outwardly, and said foot portion comprises an inclined surface engaged with said inclined surface of said ledge portion.

7. The structure of claim 5, wherein said ledge portion is defined by lugs separated by slots, and said foot portion comprises lugs sized to fit through said slots between said lugs of said ledge portion.

8. The structure of claim 5, including an intermediate wall between said inner and outer walls, and a shelf extending in said annular groove between said outer and intermediate walls, said intermediate wall located radically inwardly from said lock notches.

9. The structure of claim 8, wherein said plate structures are movable circumferentially to align said locking pointers with said lock notches, and said locking pointers slide along a portion of said annular groove adjacent said shelf and are biased toward engagement with said outer wall during said circumferential movement.

10. In a rotor for a turbine engine, said rotor including at least one rotor disc with axially extending peripheral recesses provided in the periphery of the rotor disc for receiving root portions of blades, the improvement comprising:

an annular, continuous groove provided in said disc adjacent at least one end of said peripheral recesses, said disc including a ledge portion extending from an inner wall of said annular groove and partially closing said annular groove to form a relatively narrow entrance portion thereto;

blade platforms having grooves in radial alignment with said annular groove;

a plurality of plate structures adapted to be disposed and supported between said disc and said blades, and including opposing inner and outer edges located in said grooves to form an annular array of said plate structures;

a plurality of lock notches formed in an outer wall of said annular groove; and said plate structures comprising a plate and an elongated locking pointer having an outer end supported on said plate at a location between said outer wall and said blade platform, and said locking pointer extending radically inwardly toward said outer wall, and said locking pointer extending axially away from said plate toward said outer wall and having a distal end which does not extend beyond said inner edge and which is engaged within a respective lock notch to maintain a circumferential position of said plate structures relative to said disc.

11. The structure of claim 10, wherein said locking pointer comprises an elongated resilient member, said locking pointer being resiliently biased toward said outer wall to engage within said lock notch.

12. The structure of claim 11, wherein said elongated resilient member extends through said plate for supporting said locking pointer on said plate.

13. The structure of claim 11, wherein said lock notches extend radically into said outer wall.

14. The structure of claim 11, wherein said plate structure may be disengaged from said disc by pressing said locking pointer toward said plate and moving said plate structure circumferentially relative to said disc.

15. The structure of claim 10, including a second annular continuous groove provided in said disc adjacent an opposite end of said peripheral recesses, said blade platforms having second grooves in radial alignment with said second annular groove, and a second plurality of plate structures adapted to be disposed and supported between said disc and said blades, and located in said second grooves to form a second annular array of said plate structures.

16. The structure of claim 15, wherein said annular arrays of plate structures function to limit axial movement of said blades relative to said peripheral recesses.

17. In a turbine engine comprising a rotor including at least one rotor disc with blade mounting sections provided in the periphery of the rotor disc for receiving and mounting blades, said disc including an annular groove adjacent at least one end of said blade mounting sections, a plurality of radically extending lock notches formed in an outer wall of said annular groove, and blade platforms having grooves in radial alignment with said annular groove, a plate structure comprising:

a generally planar plate for extending between said disc and said blades, and including inner and outer edges for engagement in said grooves;

an elongated locking pointer mounted on said plate at an attachment location, said locking pointer having an outer end supported between said inner and outer edges and including a distal end spaced from said attachment location radically inwardly toward said inner edge, and wherein said distal end does not extend beyond said inner edge; and said locking pointer extending radically inwardly from said attachment location and axially away from said plate toward said outer wall when said plate structure is mounted to said disc for positioning said distal end within one of said lock notches to maintain a circumferential position of said plate structure relative to said disc.

18. The structure of claim 17, wherein said locking pointer comprises a resilient elongated body member.

19. The structure of claim 18, wherein said attachment location comprises a slot through said plate and said elongated body member is threaded through said slot.

20. The structure of claim 17, wherein said inner edge includes a foot portion for engaging a ledge portion extending from said disc across a portion of said annular groove.

* * * * *